US005198015A

United States Patent [19]

Tsuji et al.

[11] Patent Number: 5,198,015

[45] Date of Patent: Mar. 30, 1993

[54] SILVER BASE ELECTRICAL CONTACT MATERIAL AND METHOD OF MAKING THE SAME

[75] Inventors: Koji Tsuji; Yoshinobu Takegawa, both of Nara; Hayato Inada, Ibaraki; Shuji Yamada, Ashiya, all of Japan

[73] Assignee: Matsushita Electric Works, Ltd., Osaka, Japan

[21] Appl. No.: 718,035

[22] Filed: Jun. 20, 1991

[30] Foreign Application Priority Data

Jun. 21, 1990 [JP] Japan ..... 2-164839
May 14, 1991 [JP] Japan ..... 3-139826

[51] Int. Cl.[5] ..... C22C 5/06
[52] U.S. Cl. ..... 75/247; 75/232
[58] Field of Search ..... 75/230, 232, 245, 247

[56] References Cited

U.S. PATENT DOCUMENTS

| | | | |
|---|---|---|---|
| 3,799,771 | 3/1974 | Harada | 75/235 |
| 4,699,763 | 10/1987 | Sinharoy et al. | 419/11 |
| 4,808,223 | 2/1989 | Ozaki et al. | 75/235 |
| 4,834,939 | 5/1989 | Bornstein | 419/21 |
| 4,874,430 | 10/1989 | Bornstein | 75/234 |
| 5,022,932 | 6/1991 | Yamada et al. | 148/13.1 |

FOREIGN PATENT DOCUMENTS

| | | |
|---|---|---|
| 0356867 | 3/1990 | European Pat. Off. . |
| 56-142803 | 11/1981 | Japan . |
| 59-159952 | 9/1984 | Japan . |
| 61-147827 | 7/1986 | Japan . |
| 61-288032 | 12/1986 | Japan . |
| 62-1835 | 1/1987 | Japan . |
| 63-238229 | 10/1988 | Japan . |
| 63-238230 | 10/1988 | Japan . |
| 1-180901 | 7/1989 | Japan . |
| 2203167 | 10/1988 | United Kingdom . |

OTHER PUBLICATIONS

World Patents Index Latest Week 8937 Derwent Publications Ltd., London, GB; AN 89-266643 & JP-A-1 192 709 (TDK Corp.) Aug. 2, 1989.

World Patents Index Latest Week 8309 Derwent Publications Ltd., London, GB; AN 83-20931 & JP-A-5-8-009 951 (Tanaka Kikinzoku) Jan. 20, 1983.

World Patents Index Latest Week 8442 Derwent Publications Ltd., London, GB; AN 84-260849 & JP-A-59 159 952 (Tanaka Kikinzoku) Sep. 10, 1984.

*Primary Examiner*—Donald P. Walsh
*Assistant Examiner*—Daniel Jenkins
*Attorney, Agent, or Firm*—Armstrong, Westerman, Hattori, McLeland, & Naughton

[57] ABSTRACT

A silver base electrical contact material with superior resistance to arc erosion along with improved wear and welding resistance. The contact material consists essentially of 0.5 to 39.9 wt % of nickel, 0.14 to 7.0 wt % of nickel oxides, and balance silver. The material contains not less than, 0.4 wt % of nickel responsible for constituting minute nickel and nickel particles which have a particle size of not more than 1 μm and are dispersed in a silver matrix for strengthening the material to give improved wear and welding resistance. The dispersed minute nickel oxide particles are included to stabilize arcing occurring at the time of opening and closing contacts in such a manner as to anchor one end of an arc substantially at any immediately available point over the entire contact surface as soon as the arcing occurs, thereby preventing the arc end from moving violently across or beyond the contact surface and therefore minimizing arc related damages or arc erosion. The contact material is made in accordance with a novel method which can disperse the minute nickel and nickel oxide particles in adequate quantities and eliminate the inclusion of undesired bulk and coarse nickel particles which would otherwise deteriorate the contact properties.

2 Claims, 12 Drawing Sheets

SILVER BASE ELECTRICAL CONTACT MATERIAL AND METHOD OF MAKING THE SAME

BACKGROUND OF THE INVENTION

1. Field of the Invention

The present invention is directed to a silver base electrical contact material, and more particularly to Ag—Ni alloy contact material with superior arc resistance especially suitable as forming contacts of hermetically sealed switches or relays and the method of making the contact material.

2. Description of the Prior Art

There have been proposed a number of silver base contact materials in which nickel particles or nickel oxides are dispersed as strengthening constituents to obtain improved mechanical strength and therefore provide sufficient wear resistance as well as anti-welding property. Such prior silver-nickel alloy contact materials and the method of making the same are disclosed in publications as listed below.

LIST OF PRIOR ART PUBLICATIONS

1) Japanese Patent Non-Examined Early Publication (KOKAI) No. 61-147827 published on Jul. 5, 1986;
2) Japanese Patent Non-Examined Early Publication (KOKAI) No. 63-238229 published on Oct. 4, 1988;
3) Japanese Patent Non-Examined Early Publication (KOKAI) No. 63-238230 published on Oct. 4, 1988;
4) Japanese patent Non-Examined Early Publication (KOKAI) No. 1-180901 published on Jul. 18, 1989;
5) Japanese Patent Non-Examined Early Publication (KOKAI) No. 56-142803 published on Nov. 7, 1981;
6) Japanese Patent Non-Examined Early Publication (KOKAI) No. 61-288032 published on Dec. 18, 1986;
7) Japanese Patent Non-Examined Early Publication (KOKAI) No. 62-1835 published on Jan. 7, 1987; and
8) Japanese Patent Non-Examined Early Publication (KOKAI) No. 59-159952 published on Sep. 10, 1984.

Japanese Patent Publication 1) [No. 61-147827] discloses an Ag—Ni contact material containing Ni particles of 1-20 μm as well as minute Ni particles of the order of submicron which are dispersed in a silver matrix for strengthening the material. The Ag—Ni contact material is made through a process of preparing a liquid solution of Ag and Ni, atomizing the solution into a corresponding alloy powder, forming a compact of the alloy powder, and heat processing the compact to obtain a resulting Ag—Ni contact material.

Japanese Patent Publication 2) [No. 63-238229] discloses an Ag—Ni contact material containing 0.5 to 20 wt % of Ni particles having a particle size of 0.01 to 1.0 μm for strengthening the material as a dispersed phase in a silver matrix. The contact material is made through a like process of preparing a liquid solution of Ag and Ni, atomizing the solution into a corresponding alloy powder, forming a compact of the alloy powder, and heat processing the compact to obtain a resulting Ag—Ni contact material.

Japanese Patent Publication 3) [No. 63-238230] discloses an Ag—Ni electrical conductive material containing Ni particles dispersed in an Ag matrix. The material is made by atomizing or solidifying a liquid mixture of Ag and 0.5 to 20 wt % of Ni to obtain a composite material containing the Ni particles of a size of 0.01 to 1.0 μm.

Japanese Patent Publication 4) [No. 1-180901] discloses an Ag—Ni contact material containing 0.5 to 30 wt % of Ni having a particle size of 1 μm or less and a method of making the contact material by rapidly atomizing by pressurized water or solidifying a molten mixture of Ag and 0.5 to 30 wt % Ni to obtain a resulting alloy forming the contact material.

Japanese Patent Publication 5) [No. 56-142803] discloses a method of making an Ag—Ni contact material through a process of atomizing a liquid mixture of Ag and Ni by a pressurized gas into a corresponding alloy powder including minute Ni particles dispersed in a silver matrix. The publication also teaches that the alloy powder may be optionally oxidized internally to form corresponding nickel oxide particles to be dispersed in the silver matrix for improved welding resistance.

Japanese Patent Publication 6) [No. 61-288032] discloses an Ag—Ni contact material made from a mixture of Ag—Ni supersaturated solid solution powder containing 1 to 5 wt % of Ni and an additional Ni powder to have a final Ni content of 5 to 40 wt %. The Ag—Ni alloy powder is obtained by atomizing a liquid solution containing Ni in such a limited amount of 1 to 5 wt % as to be capable of forming a supersaturated solid solution. Although not described in the publication, such limitation of Ni amount appears to be necessary in order to avoid the formation of relatively large Ni particles in the atomization process which would otherwise be a cause of lowering anti-welding property. In order to compensate for the reduced amount of Ni and obtain a sufficient dispersion strengthening effect, the additional amount of Ni powder is mixed with the Ag—Ni alloy powder. The mixture is then compacted and heat-processed to provide a contact material containing an increased amount of 5 to 40 wt % of Ni for improved contact properties.

Japanese Patent Publication 7) [No. 62-1835] discloses a method of making an Ag—NiO contact material through a process of obtaining an Ag—Ni alloy powder by atomization, forming a compact of the resulting powder, sintering the powder compact, and oxidizing the sintered compact to have the internally oxidized Ag—NiO composition. The Ag—Ni alloy powder atomized from a liquid mixture containing Ni in a limited amount of 6.4 wt % to give minute Ni particles dispersed in the Ag matrix, thereby dispersing the resulting minute NiO particles in the Ag matrix for improved wear resistance.

Japanese Patent Publication 8) [No. 59-159952] discloses a silver base contact material containing Ni particles together with at least one sort of metal oxide particles selected from a group consisting of $SnO_2$, CdO, NiO, $Bi_2O_3$, and $Sb_2O_3$. The contact material is made by preparing a powder mixture of Ag, Ni, and the metal oxide or oxides and sintering the powder mixture to provide a resulting alloy as a contact forming material containing 1 to 30 wt % of Ni, 0.05 to 5 wt % of the metal oxide or oxides, and balance silver. The Ni powder and the metal oxide powder is selected to have a particle volume of not more than 150 $\mu m^3$.

Although the prior Ag—Ni alloy contact materials as disclosed in the prior art 1) to 4) have been found to provide sufficient mechanical strength responsible for good wear resistance and anti-welding properties, they exhibit only poor properties against arcing developed at the time of opening and closing contacts made of the contact material. That is, very unstable arcing occurs in which the arc has its end anchored to a particular point on the contact surface over the repeated occurrences or the arc has its end moving randomly and violently across or beyond the contact surface in order to find its anchored point on the contact surface or the adjacent member. This will cause critical metal transfer at the arc anchored point or damages to the contact surface or the adjacent member, particularly when the contacts are used to flow a large load current. When the arc is anchored to a particular point, it will eventually melt the contact surface at that point over repeated occurrences of the arc to make an Ag rich condition thereat, which accelerates the contact wear and welding and therefore remarkably reducing the contact life. Such arc related damage will be outstanding and critical particularly for the contact of hermetically sealed switches or relays where arcing occurs in the absence of oxygen.

In order to lessen such contact deterioration by the arc, the prior art 5) and 7) have proposed to disperse NiO particles in the Ag matrix and the prior art 8) proposed to include NiO in addition to Ni within the Ag matrix. However, such prior art are found to be still unsatisfactory for improving the arc resistance to a practically acceptable level while at the same time retaining improved mechanical strength responsible for sufficient resistance to wear as well as welding. Much study has been concentrated to the composition of the contact material and revealed that NiO particles are responsible for stabilizing the arcing as they provide a number of cathode points acting to anchor the end of the arc. That is, the end of the arc can be readily anchored to any random one, i.e, immediately available one of a number of NiO particles as soon as the arcing takes place. In order to obtain superior arc resistance while retaining sufficient other contact properties, it is now revealed through further investigation that:

1) no substantially coarse or large particles of a particle size exceeding 10 μm must be dispersed in the Ag matrix;
2) Ni particles must be present in a certain proportion in addition to NiO particles;
3) a large proportion of minute Ni and NiO particles having a particle size of not more than 1 μm must be dispersed substantially uniformly in the Ag matrix.

It should be noted at this time that an Ag—Ni liquid mixture containing Ni in excess of 5 wt % will produce upon solidification very coarse Ni grains having a particle size of more than 10 μm in addition to resulting Ag in which minute Ni particles are dispersed. Such coarse Ni grains are very likely to cause shrinkage cavity or void defect therein or even at the interface with the Ag matrix to thereby lower workability as well as mechanical strength attendant with correspondingly lowered welding resistance. Further, the formation of such coarse Ni grains will result in fluctuated amount of minute Ni particles to be dispersed in the Ag matrix. Therefore, it is practically impossible to control the amount of the minute Ni particles when obtaining the Ag—Ni contact material from a mixture containing Ni in excess of 5 wt % and to provide a contact material with consistent contact properties.

In view of the above, Japanese Patent Publication No. 59-159952 fails to satisfy the above requirements 1) and 3) in that coarse Ni and NiO grains are likely to occur in the disclosed method of making the contact material. That is, when powders of Ag, Ni, and NiO are blended and compacted followed by being sintered as disclosed, Ni and NiO powders are liable to close together to form correspondingly coarse grains, thereby failing to disperse minute particles of Ni and NiO in the Ag matrix. In fact, this publication teaches the starting composition of Al-Ni-NiO with a particle size of Ni and NiO but it is silent on the final composition and the particle size Ni and NiO in the Ag matrix.

On the other hand, Japanese Publication Nos. 56-142803 and 62-1835 are found to fail to satisfy the above requirements 1) and 2) because of that coarse Ni grains will be likely to occur in atomizing a liquid Ag—Ni mixture containing more than 5 wt % of Ni and such coarse Ni grains are oxidized into correspondingly coarse NiO grains, and also because of that there is no teaching as to the importance of remaining Ni particles together with NiO particles in the Ag matrix.

As described in the above, the prior art silver base contact materials have been found to be unsatisfactory in providing superior anti-arc property while retaining sufficient other contact properties including electrical conductivity, wear and welding resistance.

SUMMARY OF THE INVENTION

In view of the prior art, the present invention has an object of providing an improved silver base contact material with superior anti-arc property in addition to sufficient other contact properties including electrical conductivity, wear and welding resistances, and a method of making the contact material. The silver base contact material in accordance with the present invention consists essentially of 0.5 to 39.9 wt % of Ni, 0.14 to 7.0 wt % of NiO, and balance Ag. The Ni and NiO form respective minute particles uniformly dispersed in an Ag matrix for strengthening the material to have good wear and welding resistance. The contact material contains not less than 0.4 wt % of Ni constituting the minute Ni and NiO particles having a particle size of not more than 1 μm. The minute NiO particles dispersed in the Ag matrix provide a number of uniformly distributed cathodes over a contact surface for anchoring the end of an arc which may develop at the time of opening and closing the contacts. That is, upon occurrence of the arc, the arc has its end anchored to any immediately available one of the NiO particles without causing the arc end to move randomly across or beyond the contact surface, thus stabilizing the arc and therefore greatly lessen arc related damages such as contact welding and metal transfer or arc erosion. Such arc stabilization is available with a NiO concentration of not less than 0.14 wt %. However, when the NiO proportion exceeds 7.0 wt %, the NiO particles have an increased chances of becoming close together to thereby greatly increase contact resistance beyond an unacceptable level. Thus, the NiO proportion is limited in a range of 0.14 to 7.0 wt %, and preferably 0.3 to 3.0 wt %.

On the other hand, the Ni particles should be present in a certain proportion such that Ni particles cooperate with the NiO particles to strengthen the contact material for imparting acceptable wear and welding resistance. In this respect, the dispersion strengthening effect is available with a Ni proportion of not less than 0.5 wt %. When the Ni concentration exceeds 39.9 wt %, the Ni particles will lower electrical conductivity to increase resistive heat, thereby deteriorating welding resistance as well as contact resistance. Therefore, the Ni proportion is limited to be in a range of 0.5 to 39.9 wt %, and preferably of 5.0 to 20 wt %.

The minute Ni and NiO particles should be present in a large proportion within the limited Ni content in order to maximize dispersion strengthening effect of improving the mechanical strength responsible for sufficient wear and welding resistance while assuring desired electrical conductivity or contact resistance. In this respect, the minute Ni and NiO particles having a particle size of not more than 1.0 μm should be dispersed in not less than 0.4 wt %. Further, the Ni and NiO particles are preferably of a size not more than 10 μm in order to provide an effective dispersed phase for strengthening the contact material.

It should be noted here that since the NiO particles act to stabilize the arc, the contact material of the present invention can be best utilized to form contacts of hermetically sealed switches or relays where no oxygen is supplied from the outside environment to make it impossible to reproduce NiO or other metal oxides in the contact surface by oxidization even exposed to the arc heat and therefore no arc stabilization is expected.

The above contact material can be made through an unique method which is also another object of the present invention. Firstly, it is made to prepare a silver-nickel liquid solution containing nickel in a limited content of 1 to 5 wt % so as not to produce upon solidification coarse Ni grains having a diameter of more than 10 μm which would be otherwise detrimental to formation of uniformly dispersed minute Ni and NiO particles. Then, a high pressure water jet is applied to a stream of the liquid solution so as to atomize it into an Ag—Ni composite alloy powder which contains as a dispersed phase minute Ni particles having an size of not more than 1.0 μm. During this atomization process [hereinafter referred to as a water-atomization process] the Ag—Ni alloy powder is or embedded with oxygen supplied from within the high pressure water. Subsequently, the composite alloy powder is blended with an additional Ni powder to form a compact. The compact is then sintered in such a manner as to internally oxidize Ni with the inoculated oxygen, whereby obtaining a resulting sintered material containing Ni and NiO particles substantially uniformly dispersed in Ag matrix. During this process, the minute Ni particles are wholly or partially oxidized to provide correspondingly minute NiO particles having an average particle size of not more than 10 [2 m and dispersed uniformly in the Ag matrix for arc stabilization as discussed in the above. The Ni powder added to the Ag—Ni composite alloy powder is preferably of an average size not exceeding 10 μm so as to be also uniformly dispersed in the Ag matrix of the sintered material. The sintered material is drawn in one direction to make a contact surface with a reduced cross section such that the relatively large Ni particles formed from the added Ni powder can be elongated to appear in the contact surface as minute dots or points which cooperate with the minute NiO and Ni particles resulting from the composite alloy powder to represent the contact surface with finely dotted Ni and NiO, which is most effective to minimize contact welding as these elements can restrict the flow of Ag when melted by exposure to arc heat. These and still other objects and advantageous features of the present invention will become more apparent from the following description of the invention when taking in conjunction with the attached drawings.

DESCRIPTION OF THE INVENTION

Figure 1:
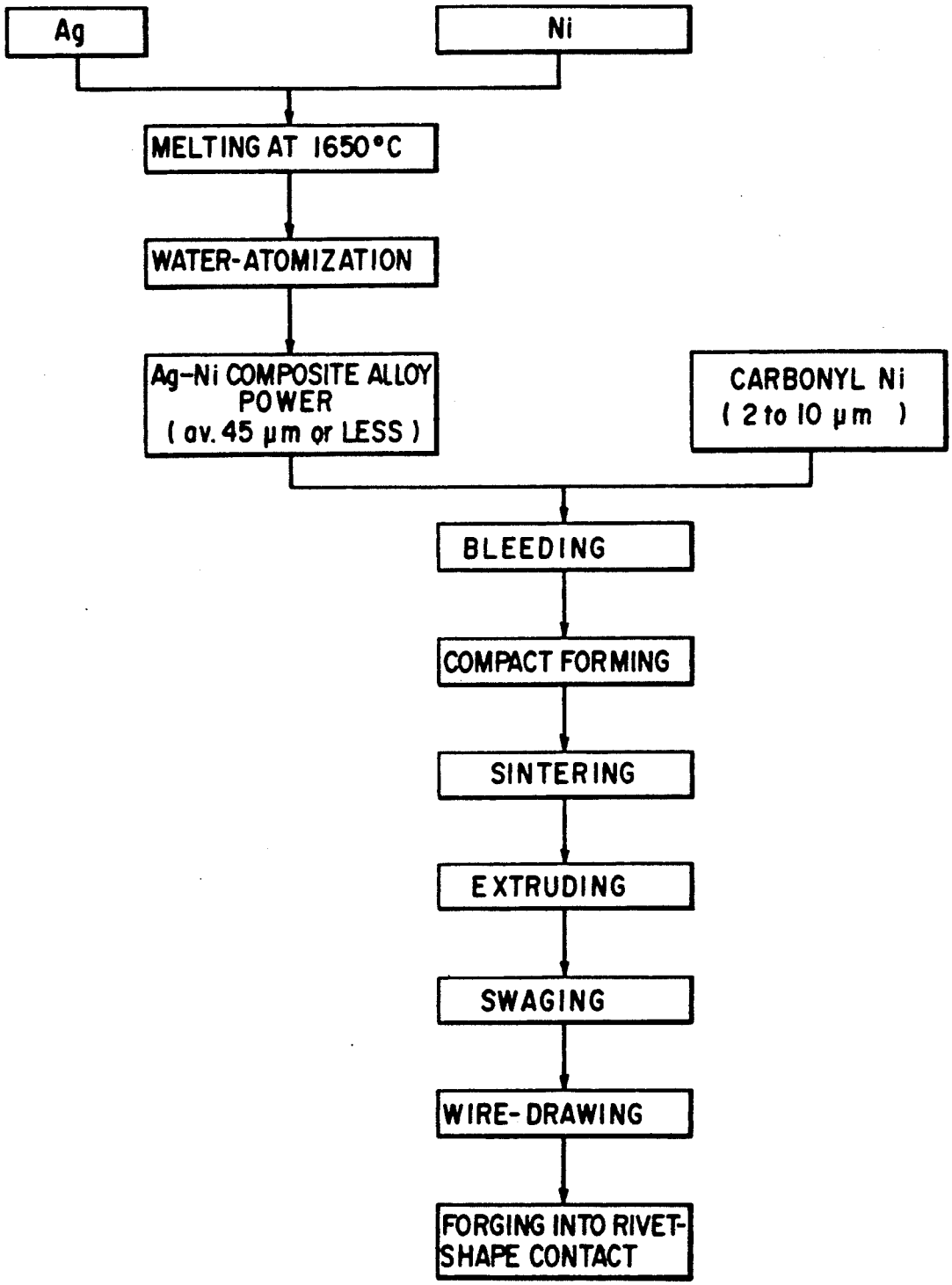
FIG. 1 is a flow chart illustrating a sequence of making an improved silver base contact material in accordance with the present invention.

The silver base contact material in accordance with the present invention is made from a blend of an Ag—Ni composite alloy powder containing 1 to 5 wt % of Ni with a carbonyl Ni powder to contain 0.5 to 39.9 wt % of Ni, 0.14 to 7.0 wt % of NiO, and balance Ag, and to have minute Ni and NiO particles uniformly dispersed in an Ag matrix for strengthening the material. As schematically shown in a flow chart of FIG. 1, the Ag—Ni composite alloy powder is obtained by firstly melting a mixture of Ag and electrolytic Ni at a temperature of approximately 1650° C. to form a liquid solution containing 1 to 5 wt % of Ni and then rapidly cooling the liquid solution through the water-atomization process. The resulting Ag—Ni composite powder containing Ni particles uniformly dispersed in the Ag matrix is blended with the carbonyl Ni powder so as to be formed into a cylindrical compact which is subsequently sintered. The resulting sintered product is processed through hot-extrusion, swaging, and wire-drawing into a wire member with a considerably reduced cross section. Finally, the wire member is cut to a suitable length followed by being forged into a rivet-shape contact ready for rivetting on a contact carrier.

Figure 2A:
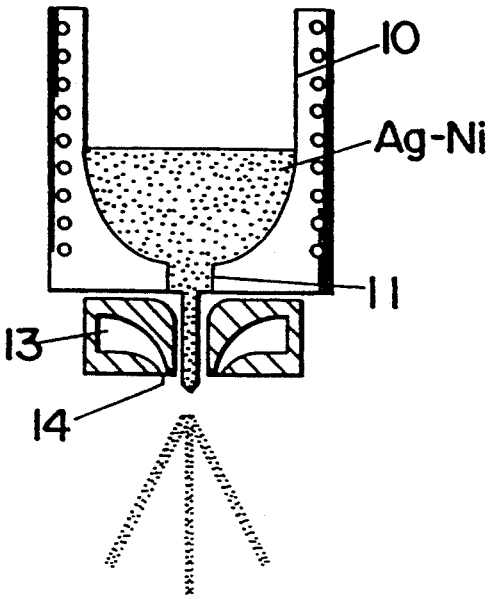
FIGS. 2A to 2C are schematic view respectively illustrating a water-atomization process, an extruding process, and a swaging process utilized in making the contact material.
Figure 3A:
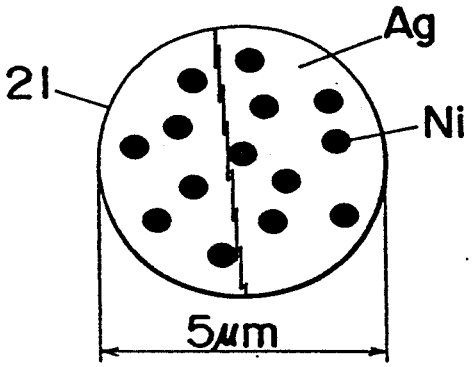
FIGS. 3A and 3B are respectively schematic representation of a section of an Ag—Ni composite alloy powder obtained through the water-atomization process and a section of the extruded contact material shown in a plane parallel to the extruding, direction.

The water-atomization is carried out by the use of a device, as shown in FIG. 2A, which has a chamber 10 storing the Ag—Ni liquid solution at a temperature of about 1650° C. The device includes a water head 12 surrounding a jet of the liquid solution discharged through a nozzle 11 at the lower end of the chamber 10. The water head 12 has a conical water passage 13 to Which high pressurized Water is supplied. The conical water passage 13 is opened in the lower end of the head 12 to form thereat an annular spout 14 through which a water jet is directed into collision with the jet of the liquid solution for rapidly cooling the liquid solution to obtain the Ag—Ni composite alloy powder containing uniformly dispersed minute Ni particles, as schematically shown in FIG. 3A, wherein black dots denote precipitated Ni particles in a white background of the Ag matrix. The Ag—Ni alloy powder is made to have an average particle size of not more than 45 μm, preferably 20 μm or less in order to be evenly and coherently blended with the Ni powder. In addition, the Ag—Ni powder is made to precipitate minute Ni particles having an average particle size of not more than 1 μm, preferably having a particle size of 0.2 to 1 μm. Since the liquid solution contains Ni in a limited amount of 1 to 5 wt %, there appears no coarse Ni grain having a particle size of more than 10 μm which would otherwise be intermingled with the Ag—Ni composite alloy powder to certainly deteriorate compatibility, sintering effect, formability, and eventually lower anti-welding property.

Further, since Ni in an amount of not more than 5 wt % can be entirely dissolved to form the liquid solution, it is expected to precipitate Ni wholly as minute Ni particles dispersed in the Ag matrix. Therefore, it is easy to exactly control the total Ni amount in the solid phase in the contact material. It should be noted in this connection that during this water-atomizing process, the alloy powder is inoculated or embedded with oxygen from within the high pressurized water, which oxygen acts to oxidize the Ni particles into NiO particles in the subsequent sintering process. The amount of oxygen taken in the alloy powder can be controlled by varying the water pressure and/or the particle size of the powder in the atomizing process, or by heat treating to reduce the powder after the atomization process. The oxygen content of the Ag—Ni powder should be in the range of 0.03 to 1.5 wt %, preferably in the range of 0.1 to 0.3 wt % so as to produce a required amount of the NiO particles dispersed in the Ag matrix. The Ag—Ni powder should contain not less than 0.4 wt % of Ni particles having a particle size of not more than 1 μm, preferably an average particle size of 0.02 to 1.0 μm and also consisting NiO particles of the like particle size after being sintered, such that the Ni and NiO particles can form a minute dispersion phase for effectively strengthening the contact material to improve contact wear and welding resistances. The above water-atomization process is found to be advantageous in providing the Ag—Ni alloy powder that has an average particle size of 45 μm or less and that contains the minute Ni particles of 1 μm or less, in a large amount efficiently within a short time period.

Thus obtained Ag—Ni composite alloy powder is blended with the carbonyl Ni powder having an average particle size of not more than 10 μm in a V-arranged mixer so as to increase a total Ni content up to 6 to 40 wt % for compensation of the reduced Ni content in the Ag—Ni powder to thereby obtain sufficient dispersion strengthening effect. Below 6 wt % of Ni forming the Ni and NiO particles in the contact material, the contact material has insufficient dispersion strengthening effect with attendant degradation in wear resistance as well as in anti-welding property. Above 40 wt % of Ni, the contact material suffers from critical lowering in electrical conductivity to thereby increase contact resistance and therefore result in contact welding. Preferably, the contact material contains 4 to 30 wt % of Ni forming the Ni and NiO particles. The carbonyl Ni powder is selected as it is economical and generally nonspherical to have a large specific surface area which is advantageous in sintering with the Ag—Ni powder and prevents exfoliation in the extruding and the subsequent processing, in addition to that it is free from shrinkage void defects. Preferably, the Ni powder has an average particle size of 5 or less [particle size of 2 to 10 μm].

Figure 2B:
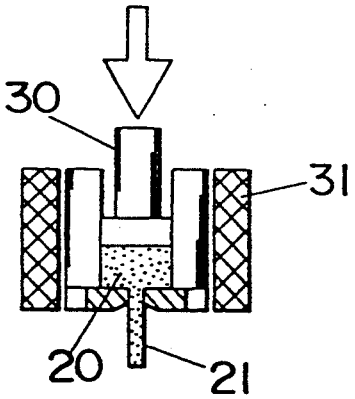
Figure 2C:
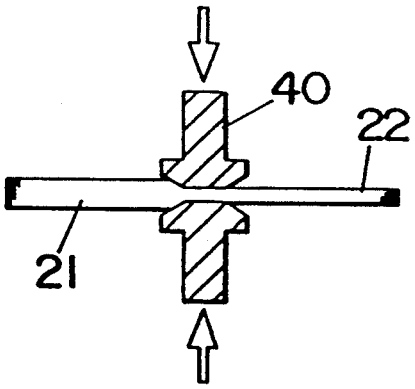
Figure 3B:
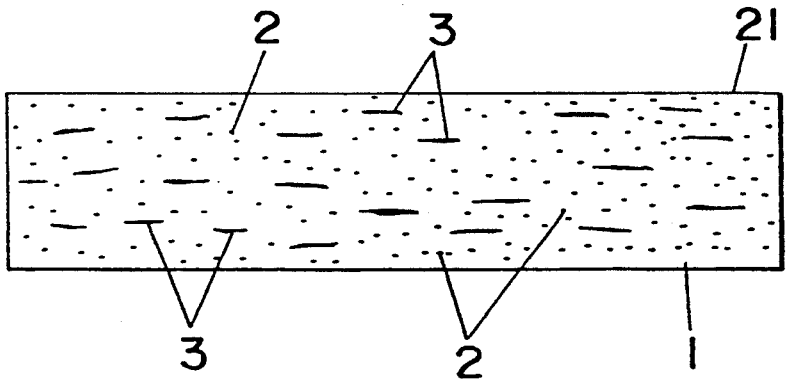

The blend of the Ag—Ni alloy powder and the carbonyl Ni powder is compacted into a cylindrical billet which is then subjected to two or three repeated cycles of sintering and hot compression. It is within this sintering process that some or substantially all of the Ni particles are internally oxidized with the oxygen contained in the Ag—Ni alloy powder into correspondingly minute NiO particles. All the sintering processes may be carried out in a vacuum condition or only an initial sintering process may be carried out at a vacuum condition and the subsequent sintering process may be at an inert gas such as nitrogen atmosphere. Because of that the NiO is formed with the oxygen contained within the Ag—Ni alloy powder and also because of that the contained amount of the oxygen can be readily controlled at the water-atomization process, it is easily possible to give a required amount of the NiO in the contact material. Further, sintering may be carried out in oxidization atmosphere to externally supply an additional amount of oxygen. Thereafter, the billet 20 is hot-extruded by the use of an extruder 30 surrounded by a heater 31, as shown in FIG. 2B, into a wire rod 21. FIG. 3B is a schematic view illustrating a section of thus obtained rod 21 taken along the extruding direction. As shown in the figure, the minute Ni and NiO particles collectively indicated by numeral 2 are uniformly dispersed in the Ag matrix 1, while the carbonyl Ni powder forms relatively large Ni particles 3 which are also uniformly dispersed in the Ag matrix 1 and are elongated in the extruding direction into a needle shape. The relatively large Ni particle 3 are further elongated as the wire rod 21 is subsequently swayed into a Wire 22 through swaging dies 40, as shown in FIG. 2C. The wire 22 is further drawn to have a reduced cross section and is cut to provide a contact surface at the cross section so that the elongated Ni particles 3 can appear as minute dots as the other Ni and NiO particles 2. Preferably, the wire 22 is processed from the billet 20 to have a reduced cross section with a reduction ratio of not less than 150 in order to make the Ni particles 3 of the carbonyl Ni minute sufficient for effectively strengthening the Ag matrix in cooperation with the minute Ni and NiO particles 2. However, the contact material of present invention is not limited to the wire rod or wire obtained through the corresponding working and may be sintered billet in which the carbonyl Ni is formed as minute dispersed phase.

Alternately, the contact material may be made from a mixture of another atomized Ag—Ni alloy powder substantially free from oxygen but containing Ni in the same limited proportion of 1 to 5 wt %. Such Ag—Ni powder may be obtained by a conventional atomizing process of spraying an Ag—Ni liquid mixture containing 1 to 5 wt % of Ni by a high pressure gas to have minute Ni particles dispersed in the Ag matrix of the resulting alloy powder. The Ni particles should be as minute as obtained in the above water-atomatization process. The resulting Ag—Ni powder is then heated at an oxygen atmosphere for internal oxidation thereof to provide Ag—Ni powder in which some of Ni are oxidized to form corresponding minute NiO particles dispersed uniformly together with the remaining Ni particles in the Ag matrix. Thus internally oxidized Ag—Ni powder is blended with the carbonyl Ni powder in the like manner as in the above process to provide a cylindrical billet which is then sintered in a vacuum or inert gas atmosphere to provide a like sintered product. Subsequently, the sintered product is processed through like hot extrusion, swaging, wire-drawing to give the contact material. In this process, the Ag—Ni powder may be internally oxidized to convert substantially all of Ni particles into NiO particles provided that the later added Ni powder can provide minute Ni particles uniformly dispersed in the Ag matrix.

In any way, the contact material should contain NiO particles in an amount of 0.14 to 7.0 wt %, preferably of 0.3 to 3.0 wt %, and contain Ni particles in an amount of 0.5 to 39.9 wt %, preferably of 5 to 20 wt %. Further, the contact material should contain minute Ni and NiO particles in a large proportion within the limitation of whole Ni content in order to maintain dispersion strengthening effect while dispersing the minute NiO particles uniformly over a contact surface to provide a number of cathodes for anchoring the end of the arc and therefore stabilizing the arc to minimize arc related damages. To this end, the minute Ni and NiO having a particle size of not more than 1.0 μm are required to be dispersed in not less than 0.4 wt %. Further, the Ni particles are preferably of a size not more than 10 μm in order to provide an effective dispersed phase for strengthening the contact material.

The above Ni and NiO concentration can be calculated based upon an oxygen equivalent concentration which can be readily obtained with respect to the contact material by differential thermal analysis with infrared spectrophotometry or the like.

The proportion of the minute Ni and NiO particles of a size not more than 1.0 μm is determined by processing an electron photomicrograph of a contact surface with a particle size distribution measurement device such as available from Rhesca Company as Drum Photoreader Model DP 300R which calibrates the photomicrograph at an increment of 0.5 μm and determines the proportion P of the minute Ni and NiO particles from the following equation:

$$P = \frac{\left[\rho_1 \times \frac{4\pi}{3} \times \left(\frac{r_1}{2}\right)^3\right] + \left[\rho_2 \times \frac{4\pi}{3} \times \left(\frac{r_2}{2}\right)^3\right]}{\Sigma\left[\rho_k \times \frac{4\pi}{3} \times \left(\frac{r_k}{2}\right)^3\right]} \times \text{Ni content (wt \%)}$$

wherein ρk is a ratio of the number of particles counted within the corresponding calibration range [0.5(k−1) to 0.5 k μm] to the total number of particles (k=1, 2, . . . ); and rk is an average diameter of the particles seen in the corresponding calibration range [0.5(k−1) to 0.5 k μm] and expressed by an equation that rk=[0.5(k−1)+0.25] μm.

The following examples and comparative examples show the comparative results with and without NiO particles dispersed in the Ag matrix, but it is to be understood that these examples are give by way of illustration and not of limitation.

EXAMPLE 1

Figure 4:
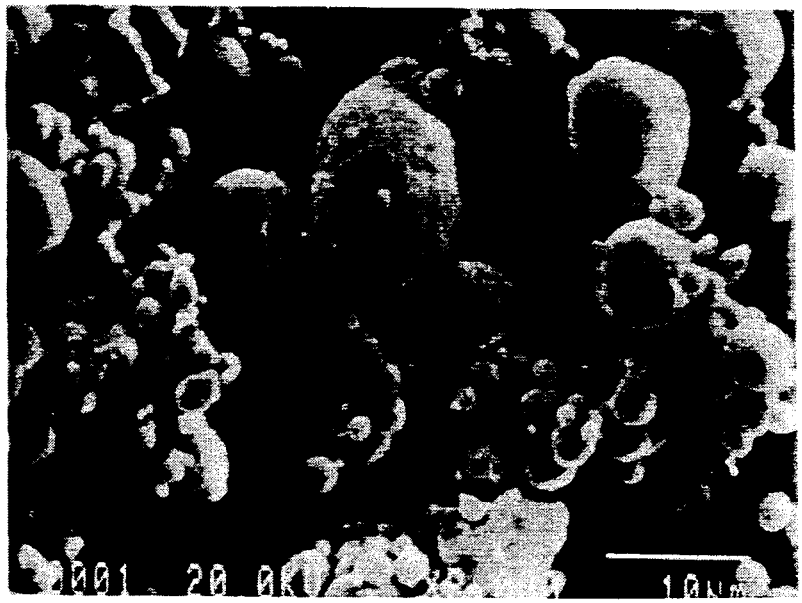
FIG. 4 is a scan-type electron photomicrograph showing the Ag—Ni composite alloy powder obtained and utilized in Example 1 of the present invention.
Figure 6:
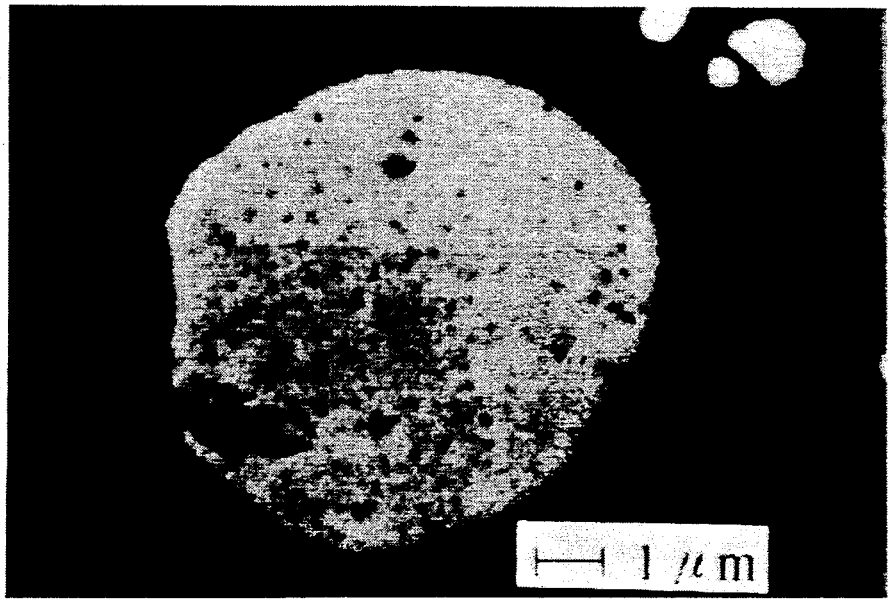
FIG. 6 is a scan-type electron photomicrograph showing an internal structure of the Ag—Ni composite ally powder of Example 1.
Figure 5:
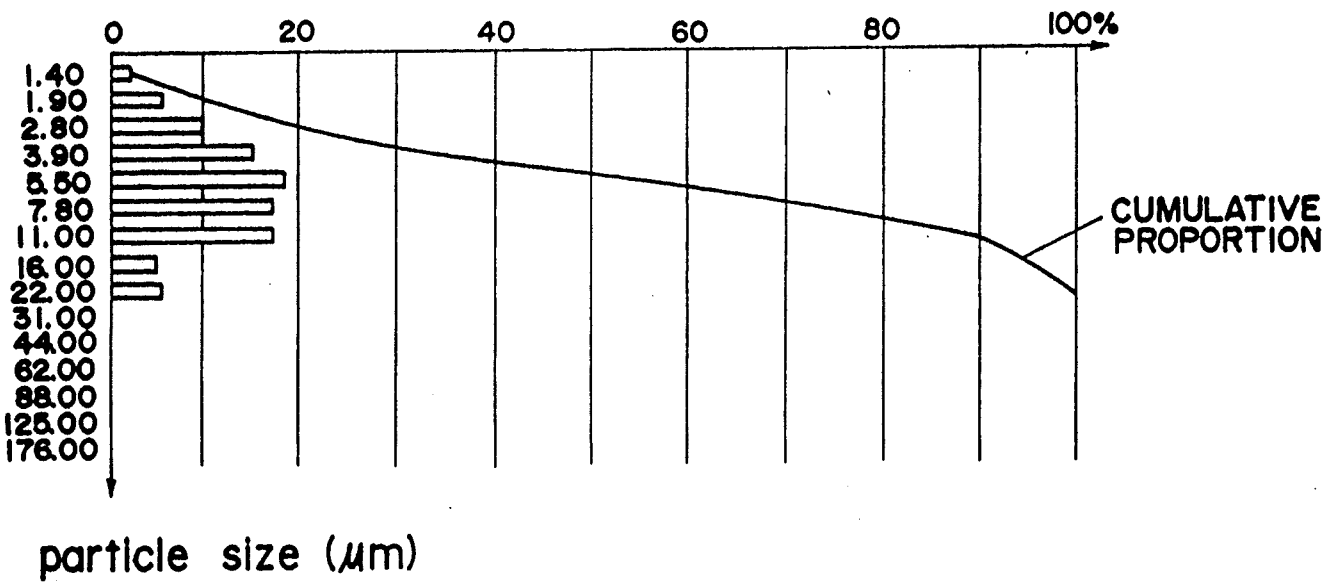
FIG. 5 is a graph illustrating a particle size distribution of the Ag—Ni composite alloy powder of Example 1.
Figure 7:
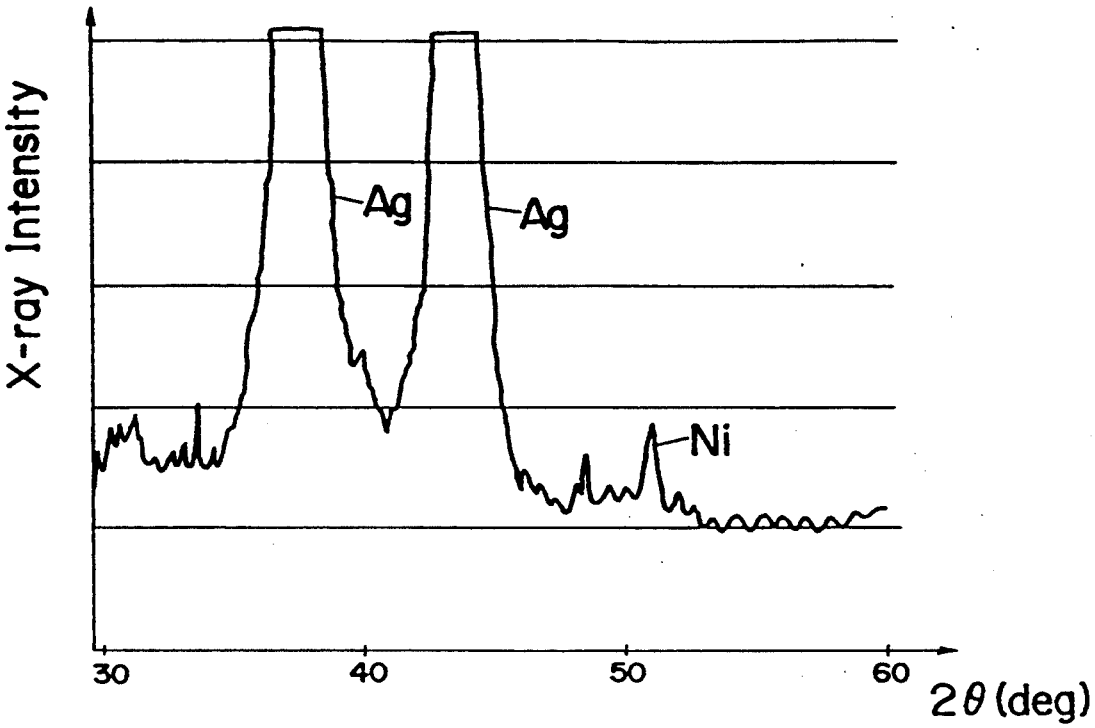
FIG. 7 is a graphic representation of an X-ray diffraction analysis of the Ag—Ni composite alloy powder of Example 1.

Ag and Ni were melted in a high frequency induction furnace to provide a 1650° C. liquid solution containing 3.2 wt % of Ni. The liquid solution was atomized by the water-atomization process using the device of FIG. 2A in which a high pressure water jet was applied to a jet of the liquid solution so as to rapidly solidify the liquid solution into an Ag—Ni composite alloy powder, as shown in a scan-type electron photomicrograph of FIG. 4. Thus obtained Ag—Ni alloy powder was analyzed to have a particle size distribution as shown in FIG. 5. From these figures, It is confirmed that the Ag—Ni powder has a particle size of 1 to 22 μm and therefore have an average particle size of not more than 20 μm. Also shown in a scan-type electron photomicrograph (reflection electron image) of FIG. 6 is an internal structure of the Ag—Ni powder in which Ni particles are indicated as tiny black dots in the white background of the Ag matrix. As apparent from the figure, the minute Ni particles having an average particle size of not more than 1 μm are uniformly dispersed in the Ag matrix. Also, it is confirmed from FIG. 7, which is an X-ray diffraction analysis of the Ag—Ni powder, that Ag and Ni are present as being indicated by remarkable peaks of X-ray intensity in the figure. Further, the Ag—Ni powder was analyzed by differential thermal analysis with infrared spectrophotometry to contain oxygen of 0.24 wt%.

Figure 8:
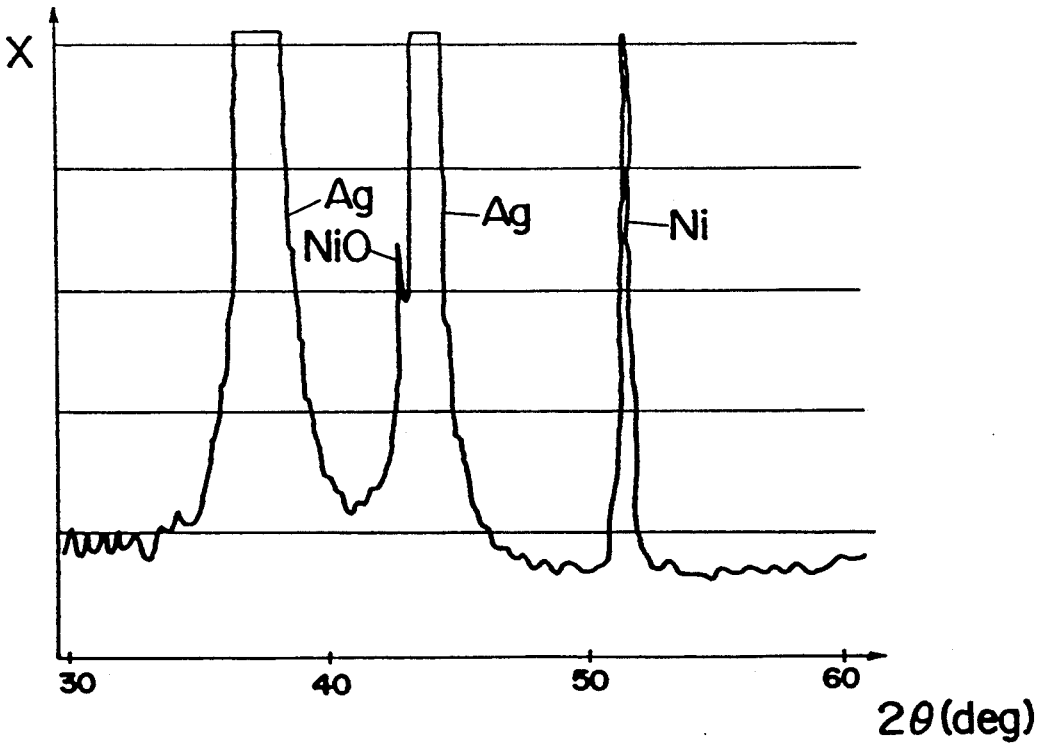
FIG. 8 is a graphic representation of an X-ray diffraction analysis of the contact material obtained in Example 1.
Figure 9:
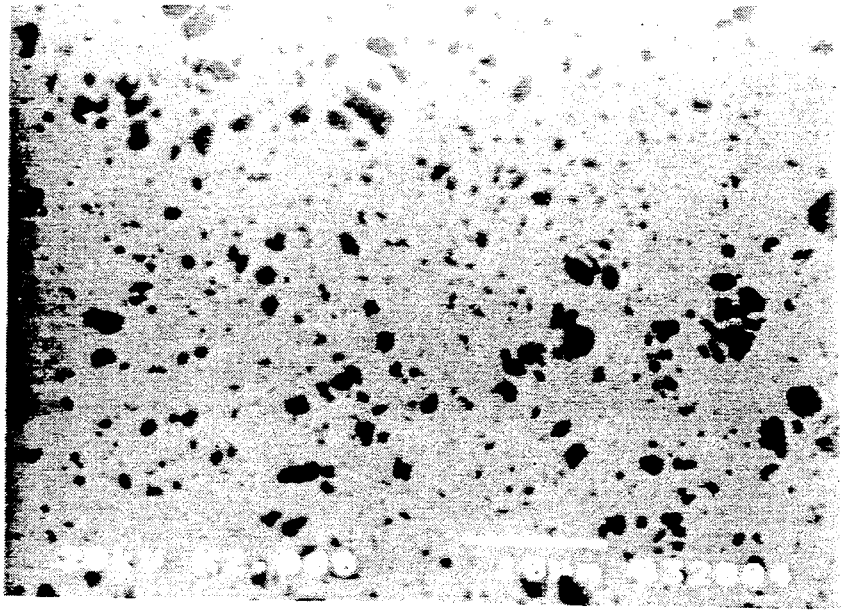
FIG. 9 is a scan-type electron photomicrograph of an internal structure of the contact material of Example 1 shown in a section perpendicular to the extruding direction.
Figure 10:
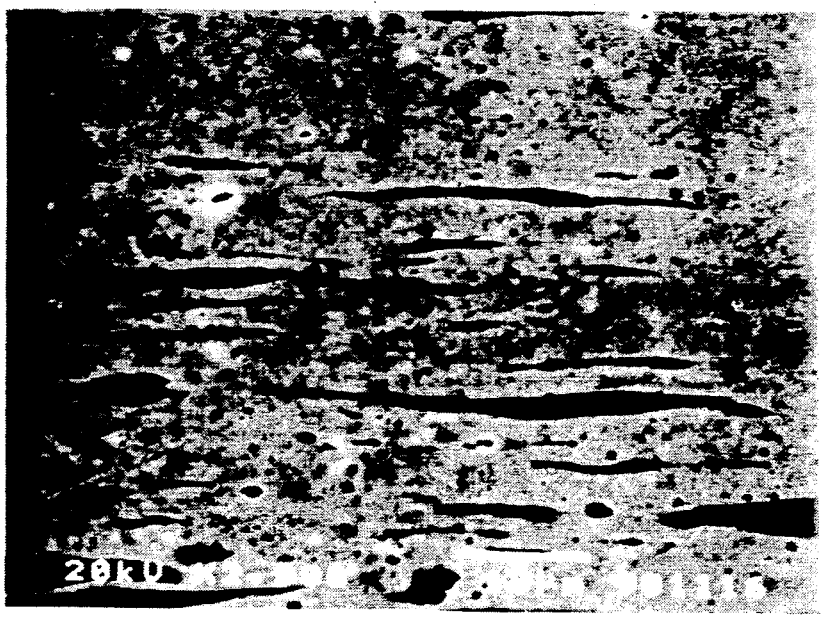
FIG. 10 is a scan-type electron photomicrograph of an internal structure of the contact material of Example 1 shown in a section parallel to the swaging direction.

Thus obtained Ag—Ni alloy powder was blended with a carbonyl Ni powder of an average particle size of 3 μm to prepare a powder mixture containing a total Ni content of 10 wt %. The power mixture was compacted at 30 kfg/mm$^2$ to provide a cylindrical billet which was subsequently sintered at 850° C. for 2 hours in a vacuum condition followed by being hot-compressed in the axial direction at 420° C. and 90 kgf/mm$^2$. The sintering and the hot-compression were repeated two more cycles to obtain a resulting sintered product having a diameter of 30 mm. Then, the product was pre-heated to a temperature of 800° C. and extruded int he extruder 30 of FIG. 2B with a die temperature maintained at 420° C. into a wire rod of 8 mm is diameter. Subsequently, the wire rod was swaged through the swaging device 40 of FIG. 2C and the was further drawn into a wire having a diameter of 2 mm, i.e., a reduced cross section with a reduction ratio of 225. An X-ray diffraction analysis was made with regard to across-section of the 8 mm diameter wire rod to show the result in FIG. 8, wherein Ag, Ni, and NiO appears as being indicated by peaks of X-ray intensity, from which it is confirmed that some of the Ni particles dispersed in the Ag matrix were converted into corresponding NiO particles as being reacted with the oxygen taken in the Ag—Ni powder. Also, the like cross section of the 8 mm diameter wire rod was monitored to have a scan-type electron photomicrograph of FIG. 9. Finally, the 2 mm diameter wire was cut to a suitable length and hammered at its one end into a rivet-shaped test piece contact having a constant surface corresponding to the cross section of the wire. As shown in FIG. 10 which is a scan-type electron photomicrograph (reflection electron image) of a section of the 2 mm diameter wire taken in parallel with the swaging or drawing direction, it is also confirmed that the added carbonyl Ni are elongated without causing any void defector exfoliation at the interface with the Ag matrix to thereby give fine dots of Ni in the cross section of the wire or the contact surface.

EXAMPLE 2

A rivet-shaped test piece contact was obtained through the identical processes as made in Example 1 except that carbonyl Ni powder was blended in a different amount with the Ag—Ni powder obtained in Example 1 to have a differing total Ni content of 7.5 wt% in the contact.

EXAMPLE 3

An Ag—3.2 wt% Ni alloy powder was obtained by the like water-atomization process as in Example 1 to have a differing oxygen content of 0.19 wt %. The Ag—Ni alloy powder was blended with the same amount of carbonyl Ni to form a 110 mm diameter billet which was subjected to the identical processing as Example 1 to provide a 2 mm diameter wire with a reduction ratio of 3025. The wire was forged in the like manner as Example 1 to obtain a rivet-shaped contact.

EXAMPLE 4

An Ag—3.2 wt % Ni alloy powder was obtained by the like water-atomization process as in Example 1 to have a differing oxygen content of 0.19 wt %. The Ag—Ni alloy powder was blended with the differing amount of carbonyl Ni to form a 110 mm diameter billet having a total Ni content of 7.5 wt %. The billet was subjected to the identical processing as Example 1 to provide a 2 mm diameter wire with a reduction ration of 3025. The wire was forged in the like manner as Example 1 to obtain a rivet-shaped contact.

EXAMPLE 5

An Ag—5.0 wt % Ni alloy powder was obtained by the like water-atomization process as in Example 1 and was heated at 450° C. at a 4 atm oxygen atmosphere for internal oxidation of Ni into NiO in a greater amount than expected with the oxygen contained in the Ag—Ni powder. Thus internally oxidized powder was blended with a carbonyl Ni to have a total Ni content of 6.0 wt % and was processed in the identical manner as in Example 1 to obtain a rivet-shaped test piece contact.

EXAMPLE 6

The Ag—3.2 wt % Ni alloy powder obtained in Example 1 was subjected to heat treatment under a condition of 450° C. for 5 hours in a hydrogen atmosphere for reducing the oxygen content in the powder. Then the alloy powder was blended with a carbonyl Ni powder and processed in the identical manner as Example 1 to obtain a rivet-shaped test piece contact.

EXAMPLE 7

The Ag—3.2 wt % Ni alloy powder obtained in Example 1 was blended with a differing amount of carbonyl Ni powder to have a total Ni content of 13 wt % and was compacted into a billet in the identical manner as in Example 1. The billet was firstly sintered in a vacuum condition as in Example 1. The second and third sintering were performed in a nitrogen atmosphere to provide a like sintered billet which was processed in the identical manner as Example 1 to obtain a rivet-shaped test piece contact.

EXAMPLE 8

An Ag—5.0 wt % Ni alloy powder was obtained by the like water-atomization process as in Example 1 and blended with a carbonyl Ni to have a total Ni content of 7 wt % to form a like billet which was firstly sintered in the like vacuum condition as in Example 1. The second and third sintering were made in an nitrogen atmosphere to provide a sintered billet which was subsequently processed in the identical manner to obtain a rivet-shaped test piece contact.

EXAMPLE 9

An Ag—1.0 wt % Ni alloy powder was obtained by the like water-atomization process as in Example 1 and blended with a carbonyl Ni to have a total Ni content of 20 wt % to form a like billet which was firstly sintered in the like vacuum condition as in Example 1. The second and third sintering were made in an nitrogen atmosphere to provide a sintered billet which was subsequently processed in the identical manner to obtain a rivet-shaped test piece contact.

EXAMPLE 10

An Ag—1.0 wt % Ni alloy powder was obtained by the like water-atomization process as in Example 1 and blended with a carbonyl Ni to have a total Ni content of 40 wt % to form a like billet which was firstly sintered in the like vacuum condition as in Example 1. The second and third sintering were made in an nitrogen atmosphere to provide a sintered billet which was subsequently processed in the identical manner to obtain a rivet-shaped test piece contact.

COMPARATIVE EXAMPLE 1

Figure 11:
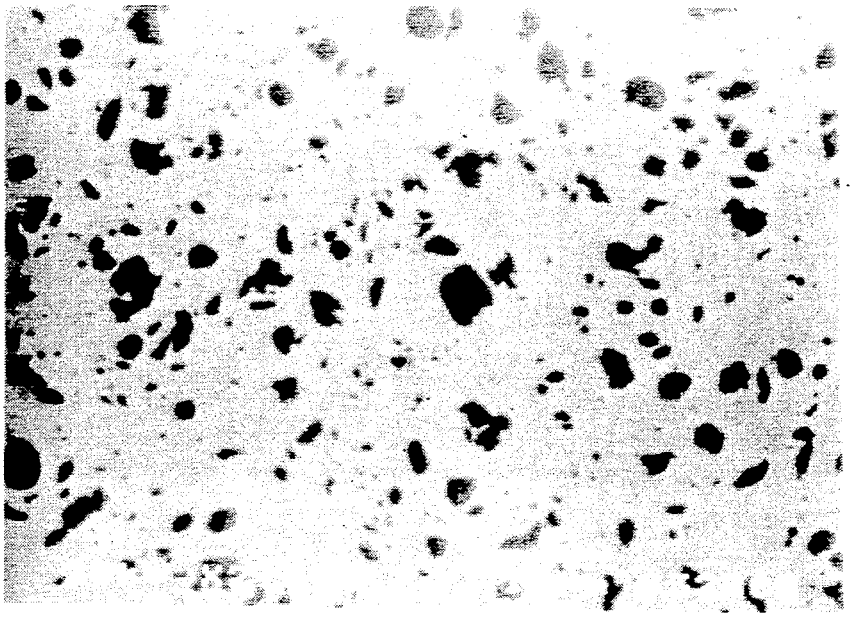
FIG. 11 is a scan-type electron photomicrograph of an internal structure of a contact material obtained in comparative Example 1 shown in a section perpendicular to the swaging direction.

An electrolytic Ag powder having a particle size of about 45 μm was blended with a carbonyl Ni powder to have a total Ni content of 10 wt % to form a like billet which was subjected to the same sintering, extruding, swaging, and wire-drawing processes as Example 1 to be formed into a 2 mm diameter wire of which cross section is shown in FIG. 11 which is a scan-type electron photomicrograph (reflection electron image). The wire was then hammered to obtain a rivet-shaped test piece contact.

COMPARATIVE EXAMPLE 2

Figure 12:
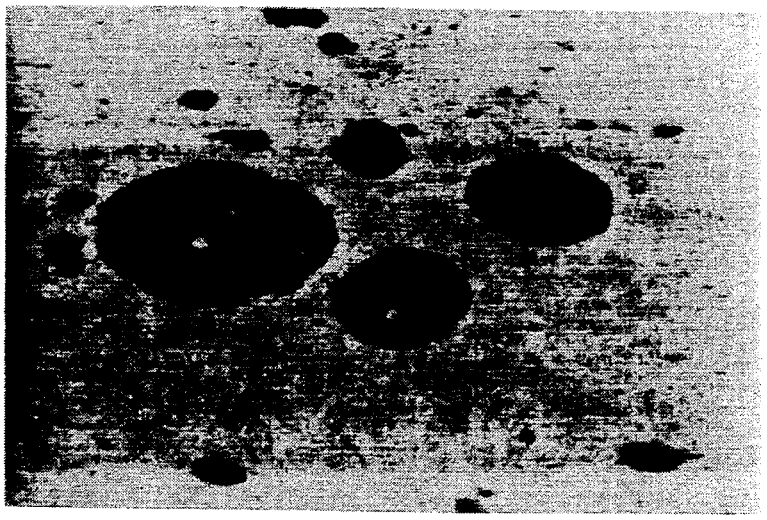
FIG. 12 is a photc micrograph of an internal structure of the contact material obtained in comparative Example 2 shown in a section perpendicular to the swaging direction.
Figure 13:
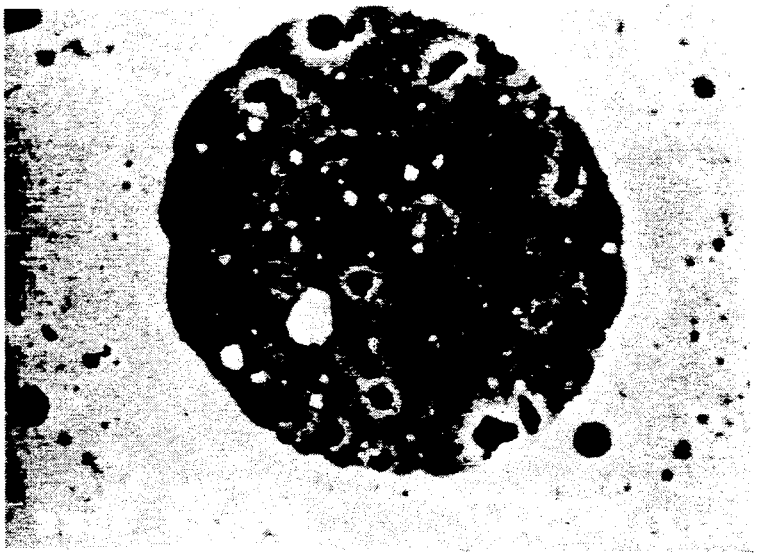
FIG. 13 is a scan-type electron photomicrograph of an internal structure of a coarse Ni particle contained in the contact material of comparative Example 2.

Ag and Ni were melted in a high frequency induction 1 furnace to have a 1650° C. liquid mixture containing 10 wt % of Ni and balance Ag. The liquid mixture was atomized into a powder through the gas-atomization process in which the liquid mixture was sprayed through a nozzle into collision with a high pressure argon gas jet to be rapidly solidified thereby. The resulting powder was found to be a mixture of coarse Ni powder and an Ag—Ni alloy powder in which minute Ni particles are dispersed in the Ag. The powder mixture was sieved to select the powder having a particle size of 45 μm or under. Thus selected powder was then compacted to form a like billet of which Ni content was 9.1 wt %. Thereafter, the billet was subjected to the identical sintering, extruding, swaging and wire-drawing processing as Example 1 to give a 2 mm diameter wire of which cross section is shown in a photomicrograph of FIG. 12 wherein relative large Ni particles exceeding 10 μm in diameter are seen as grey ones in the white background of the Ag matrix. As apparent from the figure, there occur voids as appearing as black areas around the large Ni particles to cause exfoliation between the Ni particles and the Ag matrix which results certainly in fatal contact defects. Also shown in FIG. 13 is a scan-type electron microphotograph of the large Ni particle wherein black portions indicate shrinkage voids which are thought to develop due to the rapid solidification of Ni having a relatively high melting point. Such large or coarse Ni particles with the voids will certainly provide an increased chance of becoming close together in the contact surface to thereby lower thermal conductivity, to lessen anti-welding property and increase contact resistance and therefore degrading the contact. The above wire was formed into a rivet-shaped test piece contact.

Evaluation of Contact Material

The test piece contacts of Examples 1 to 10 as well as (those of comparative Examples 1 to 2 were tested to evaluate anti-welding property, wearing resistance, and contact resistance in accordance with ASTM (American Society for Testing and Materials) B 182-49 under make-break conditions of 100 volts, 40 amps at an open air environment with a resistive load connected over 50,000 contact cycles for 3 samples of each contact. These contacts were also examined as to the content of oxygen forming the NiO particles as well as the proportion of the minute Ni and NiO particles having a particle size of not more than 1 μm with the above described analysis based on the photomicrograph of the contact material. The results are shown in Table 1 below.

TABLE 1

| | Ni wt % in Ag—Ni alloy powder | Total Ni wt % | $O_2$ wt % | Ni wt % [Ni particle] | NiO wt % [NiO particle] | minute particle proportion [wt %] | the number of contact welding | contact wearing [mg] | contact resistance [Ω] |
|---|---|---|---|---|---|---|---|---|---|
| Example 1 | 3.2 | 10 | 0.20 | 9.27 | 0.93 | 2.0 | 10 | 2.9 | 0.37 |
| Example 2 | 3.2 | 7.5 | 0.22 | 6.69 | 1.03 | 2.0 | 8 | 3.0 | 0.41 |
| Example 3 | 3.2 | 10 | 0.14 | 9.49 | 0.65 | 2.1 | 2 | 2.8 | 0.43 |
| Example 4 | 3.2 | 7.5 | 0.14 | 6.79 | 0.65 | 1.9 | 2 | 3.0 | 0.40 |
| Example 5 | 5.0 | 6.0 | 1.30 | 1.23 | 6.07 | 2.0 | 7 | 2.1 | 0.45 |
| Example 6 | 3.2 | 10 | 0.05 | 9.82 | 0.23 | 2.0 | 3 | 2.7 | 0.38 |
| Example 7 | 3.2 | 13 | 0.21 | 12.23 | 0.98 | 1.9 | 11 | 2.0 | 0.41 |
| Example 8 | 5.0 | 7 | 0.23 | 6.16 | 1.07 | 4.5 | 5 | 2.4 | 0.35 |
| Example 9 | 1.0 | 20 | 0.15 | 19.45 | 0.70 | 0.4 | 12 | 1.8 | 0.48 |
| Example 10 | 1.0 | 40 | 0.16 | 39.41 | 0.75 | 0.4 | 15 | 2.0 | 0.55 |
| Comparative Example 1 | — | 10 | — | 10.00 | 0 | 0.2 | 33 | 3.5 | 0.38 |
| Comparative Example 2 | — | 9.1 | — | 9.10 | 0 | 3.7 | 65 | 3.3 | 0.65 |

Figure 14:
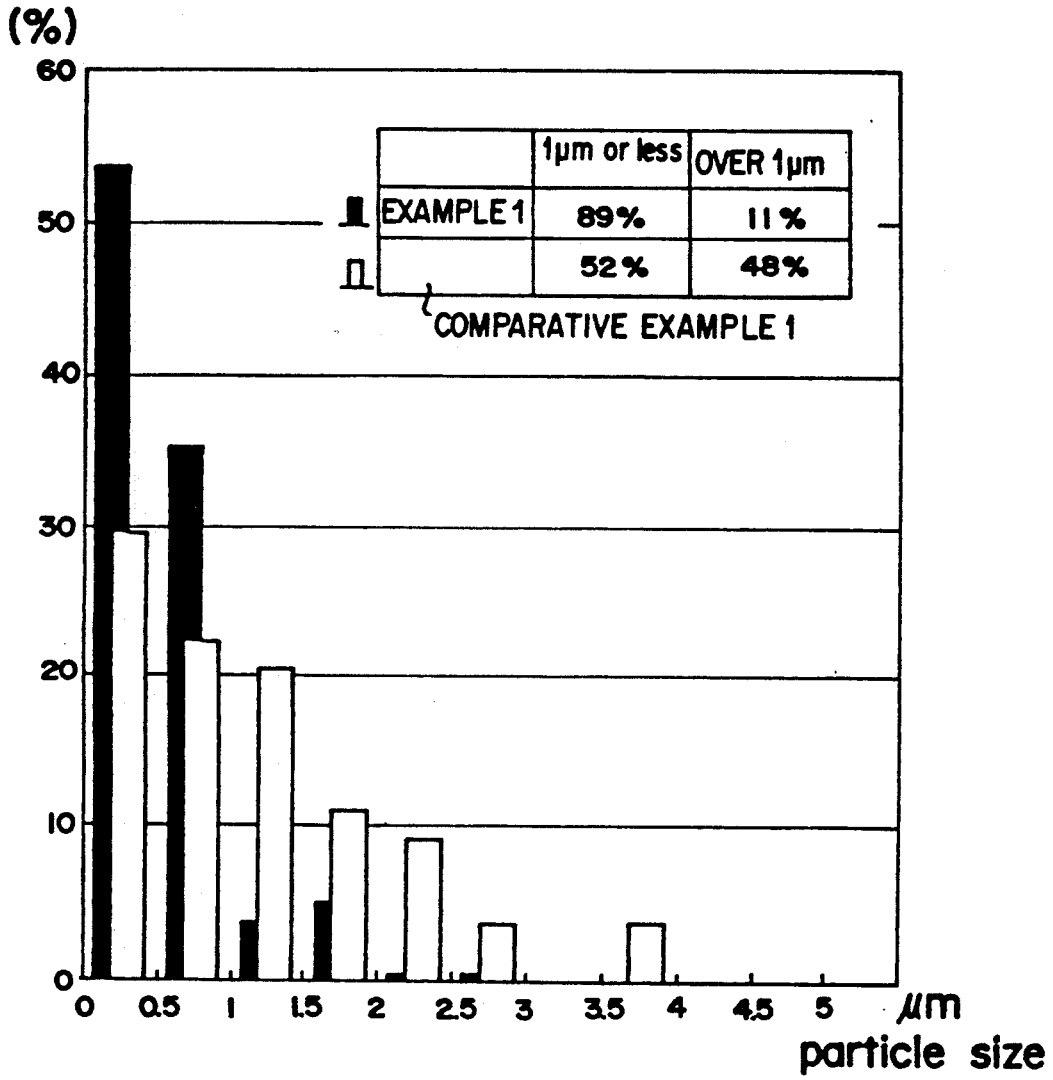
FIG. 14 is a bar graph illustrating a particle size distribution of Ni and NiO particles dispersed in Ag matrix corresponding respectively to Example 1 of FIGS. 10 and comparative Example of FIG. 11.

As apparent from Table 1, the contacts of Examples 1 to 10 exhibit superior anti-welding property and wear resistance over the contacts of comparative Examples 1 and 2. Such superior contact property is thought to result from the fact that a large number of the minute Ni and NiO particles are uniformly dispersed between the later-added carbonyl Ni powder of relative large size in the contact materials, as shown in FIG. 9 of Example 1, in contrast to FIG. 11 of comparative Example 1. This is confirmed from a bar graph of FIG. 14 which illustrates particle size distribution for Example 1 in comparison with comparative Example 1.

Figure 15:
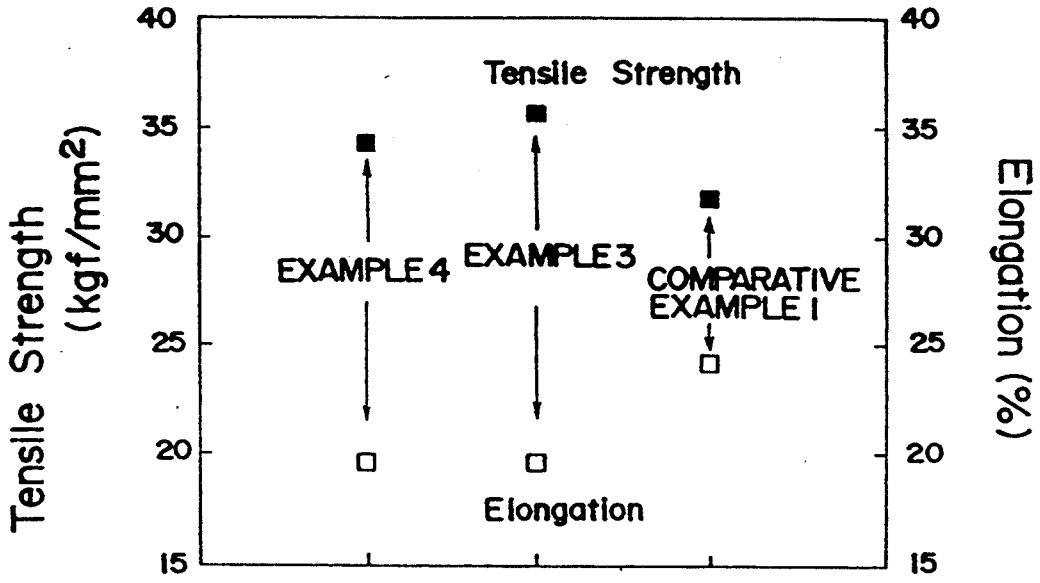
FIG. 15 is a graph illustrating tensile strength and elongation for Examples 3 and 4 in comparison with those for comparative Example 1.

For evaluation of mechanical strength, tensile tests were made to determine tensile strength and elongation for Examples 3 and 4 and for comparative Example 1 at a strain rate of $6.67\times10^{-4}$ with a gauge length of 5 mm for 4 mm diameter wires of the respective contact materials. The result is shown in FIG. 15 from which it is known that the contact material as typically represented by Examples 3 and 4 exhibits superior mechanical strength responsible for the anti-welding property and wear resistance over that of comparative Example 1 due to the improved dispersion effect of the minute Ni and NiO particles.

Figure 16:
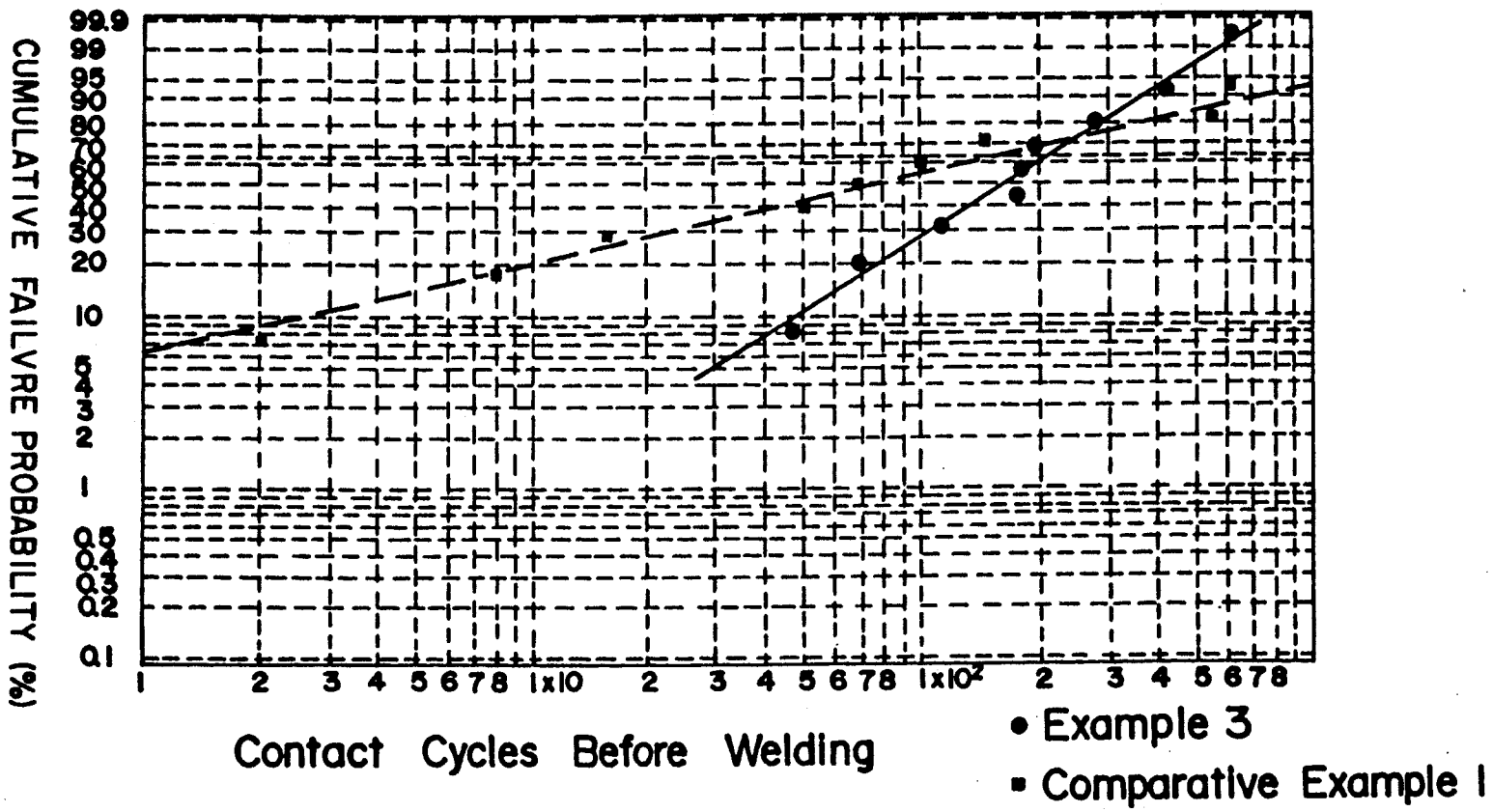
FIG. 16 is a graph illustrating Weibull distribution of the number of contact cycles before welding in relation to cumulative failure probability for the contacts of Example 3 and comparative Example 1, respectively.

Further, the test piece contacts of Example 3 and comparative Example 1 were tested as to the occurrence of welding under make-break conditions of 100 volts, rush current of 40 amps, and steady state current of 20 amps and at make-contact force of 100 gf, break-contact force of 150 gf with a captive load connected. The result is shown in FIG. 16 which is Weibull distribution graph indicating the relation between the number of contact cycles before initial welding and cumulative failure probability for Example 3 [marked by round dots in the figure] and comparative Example 1 [marked by square dots in the figure]. As seen in the figure, Example 3 shows 90% reliability $\rho_{90}$ [i.e., 10% cumulative failure probability] after the extended contact cycles of 47.4, while comparative Example 1 shows $\rho_{90}$ only after a short contact cycles of as less as 2.4, which means that Example 3 has improved anti-welding property about 20 times than that of comparative Example 1.

Further, tests were made to examine the anti-welding property as well as wear resistance for test piece contacts of Examples 1, 3 to 6, and those of comparative Examples 1 and 2 under the sealed condition from the surrounding air. To this end, test pieces contacts were incorporated respectively into hermetically sealed relays. The anti-welding property was evaluated in terms of whether the contact welding occurs within the 100,000 contacting cycles under conditions of 250 volts, 8 amps with a resistive load connected. The wear resistance was judged in terms of insulation resistance between the contacts which tends to lower as scattered powders produced as a result of contact wearing will constitute an electric path between the open contacts. The insulation resistance was judged to be critically lowered or deteriorated when there sees a leak current of exceeding 10 mA under the conditions of applying 1 kV across the contacts for one minutes. The results are shown in Table 2 below.

TABLE 2

| | contact welding | contact wearing [insulation resistance lowering] |
|---|---|---|
| Example 1 | none | none |
| Example 3 | none | none |
| Example 4 | none | none |
| Example 5 | none | none |
| Example 6 | none | none |
| Comparative Example 1 | occurred | occurred |
| Comparative Example 2 | occurred | occurred |

Figure 17:
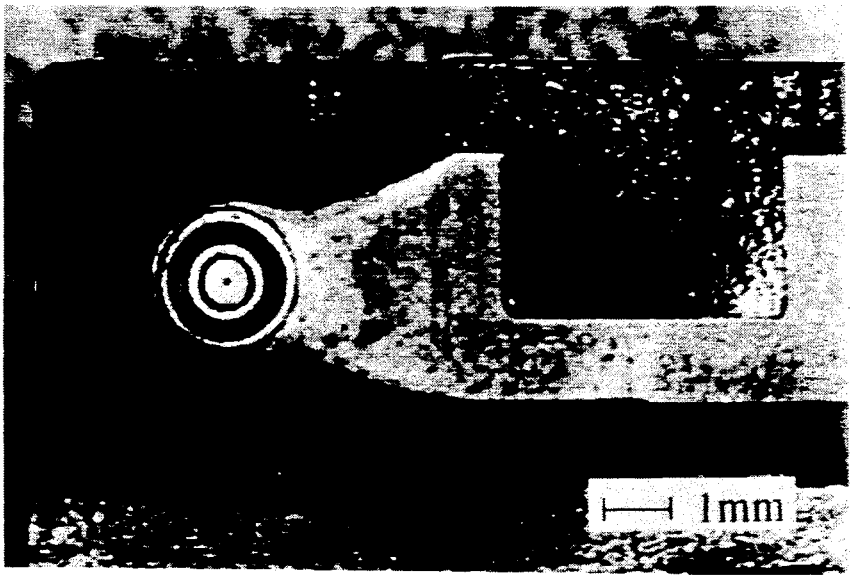
FIG. 17 is a photograph illustrating a condition of a contact formed of the contact material of Example 3 and its associated parts constituting a hermetically sealed relay after experiencing 100,000 make-break contact cycles.
Figure 18:
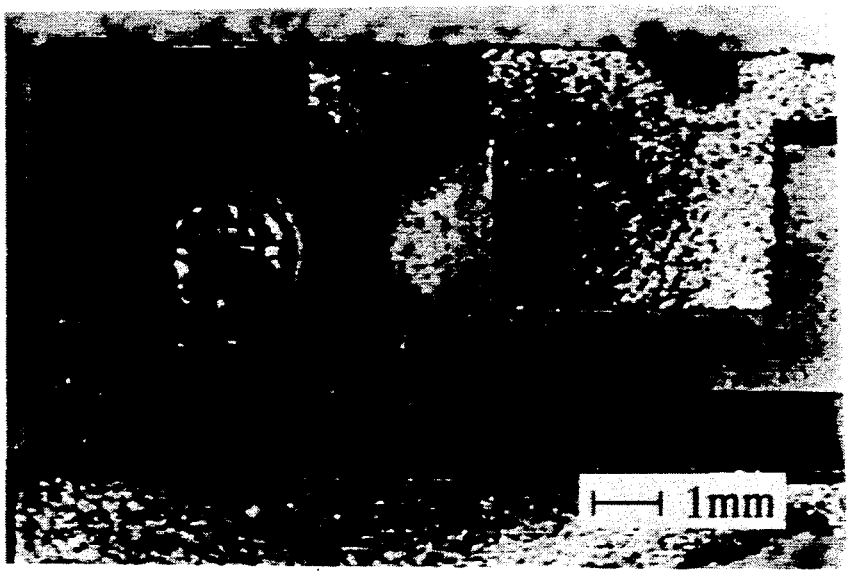
FIG. 18 is a photograph illustrating a condition of a contact formed of the contact material of comparative Example 1 and its associated parts constituting a hermetically sealed relay after experiencing 100,000 make-break contact cycles.

After the above tests, observation was made to the contacts and the adjacent parts thereof for the respective relays. As seen in FIGS. 17 and 18, the relay incorporating the contacts of the Examples indicates that the arc is only limited to the contact surface and does not extend beyond the contact [FIG. 17], while the relay with the contacts of the comparative Examples indicates that the arc extends to a contact carrying spring to give damages thereto [FIG. 18]. From Table 2 and FIGS. 17 and 18, it is confirmed that the NiO particles dispersed in the contact surface can certainly act to stabilize the arc and therefore minimize the arc related welding and wearing even in the sealed condition isolated from the outside air.

What is claimed is:

1. A silver based electrical contact material consisting essentially of 0.5 to 39.9 wt % nickel, 0.14 to 7.0 wt % nickel oxides, and balance silver, said nickel being in the form of essentially pure nickel particles and said nickel oxides being in the form of separate essentially pure particles of nickel oxides, both said particles being dispersed in a silver matrix for strengthening said material, said nickel particles being micron nickel particles having a particle size of 1 to 10 μm and submicron nickel particles having a particle size of not more than one μm and said nickel oxide particles being submicron particles having a particle size of not more than 1 μm.

2. A silver base electrical contact material as set forth in claim 1, wherein said nickel and nickel oxide particles have a particles size of not more than 10 μm.

* * * * *